US007694384B2

(12) United States Patent
Park et al.

(10) Patent No.: US 7,694,384 B2
(45) Date of Patent: Apr. 13, 2010

(54) VACUUM CLEANER

(75) Inventors: Tae Jin Park, Gimhae-si (KR); Sang Jun Park, Changwon-si (KR); Kang Won Moon, Changwon-si (KR); Seog Yong Kim, Changwon-si (KR); Suck Hyun Moon, Masan-si (KR)

(73) Assignee: LG Electronics Inc., Seoul (KR)

( * ) Notice: Subject to any disclaimer, the term of this patent is extended or adjusted under 35 U.S.C. 154(b) by 1527 days.

(21) Appl. No.: 11/000,918

(22) Filed: Dec. 2, 2004

(65) Prior Publication Data

US 2005/0138761 A1 Jun. 30, 2005

(30) Foreign Application Priority Data

Dec. 27, 2003 (KR) ..... 10-2003-0098401

(51) Int. Cl.
*A47L 9/10* (2006.01)

(52) U.S. Cl. ..... 15/352; 15/327.7; 15/327.1; 15/353

(58) Field of Classification Search ..... 15/327.1, 15/327.7, 352, 353
See application file for complete search history.

(56) References Cited

U.S. PATENT DOCUMENTS 6,192,550 B1 * 2/2001 Hamada et al. ..... 15/352
6,766,558 B1 * 7/2004 Matsumoto et al. ..... 15/353
6,818,032 B2 * 11/2004 Bilek et al. ..... 55/337
6,922,868 B1 * 8/2005 Jeong ..... 15/353
7,052,523 B2 * 5/2006 Murphy et al. ..... 55/330

* cited by examiner

*Primary Examiner*—Joseph J Hail, III
*Assistant Examiner*—Shantese McDonald
(74) *Attorney, Agent, or Firm*—KED & Associates LLP

(57) ABSTRACT

Disclosed is a vacuum cleaner including a head having an inlet for sucking in air containing impurities from outside; a dust collector including: a dust collecting container having a handle on a side thereof, and sucking in polluted air and collecting impurities separated from the polluted air, and having an opened top surface for discharging air separated from the impurities; and a top lid including a fixing groove and a guiding member, and detachably provided at the dust collecting container for closing the opened top of the dust collecting container, wherein the guiding member is coupled to a predetermined part of the dust collecting container such that the fixing groove is positioned at a predetermined location when the top lid is assembled with the dust collecting container; a main body having a dust collector receiving recess in front part thereof, wherein the dust collector is detachably provided; and a fixing device provided at an upper front portion above the dust collector receiving recess, and having a protrusion caught by the fixing groove of the top lid, the fixing device fixing the dust collector on the main body, and releasing the dust collector when the dust collector is separated from the main body.

19 Claims, 4 Drawing Sheets

VACUUM CLEANER

CROSS-REFERENCE TO RELATED APPLICATIONS

This application claims the benefit of Korean Application No. P2003-98401, filed on Dec. 27, 2003, which is hereby incorporated by reference as if fully set forth herein.

BACKGROUND OF THE INVENTION

1. Field of the Invention

The present invention relates to a vacuum cleaner, and more particularly, to a vacuum cleaner having a dust collector.

2. Discussion of the Related Art

In general, as an apparatus for cleaning a floor or a carpet of an interior, a vacuum cleaner sucks in polluted outside air containing impurities through an operation of an air suction device such as a motor provided in a main boy thereof, collects impurities separated from polluted air, and discharges cleaned air to an outside thereof.

Hereinafter, a related art upright type vacuum cleaner will be described referring to FIG. 1. Referring to FIG. 1, the related art vacuum cleaner includes a head 2 moving on a floor and sucking polluted air with impurities, a main body 4 provided at an upper part of the head 2 and having an air suction device therein for generating air sucking force, and a cleaner handle 6 coupled with an upper part of the main body 4.

The heads 2, through an inlet provided on a bottom surface thereof, sucks in polluted air with impurities by operating the air suction device while moving on the floor to be cleaned.

As aforementioned, the main body 4 includes the air suction device (not shown) generating sucking force, and sucks in polluted air with impurities through the inlet by operating the air suction device.

The main body 4 is hinge coupled with an upper rear part of the head 2, and the body 4 is inclined rearward to a predetermined angle from the head 2.

A cleaner handle 6 for a user to operate the movement of the vacuum cleaner is coupled to the upper part of the main body 4, thereby allowing the user to clean a desired area adjusting inclination angle of the main body 4.

Meanwhile, on a front surface of the main body 4, a dust collector 8 is detachably provided for collecting impurities separated from the polluted air, and a fixing device is provided at the main body, particularly at an upper part of the dust collector, for detaching the dust collector.

In this case, the dust collector 8 includes a cylindrical container 8*a* having an opened top for receiving impurities separated from the polluted air, and a top lid 8*b* having a fixing groove coupled with the fixing device provided on a top thereof.

The fixing device includes a knob 7 for detaching the dust collector at an upper part of the main body. In more detail, at a rear end portion of the knob, a hook (not shown) projected toward the top lid of the dust collector is provided. By inserting the hook into the fixing groove 8*c*, the dust collector is fixed, thereby preventing the dust collector from escaping from the main body 4.

In the related art upright type vacuum cleaner configured as aforementioned, when a predetermined time passed, the dust collector is piled with impurities. Accordingly, a user needs to empty the dust collector and install the dust collector back to the main body.

However, the related art vacuum cleaner configured as aforementioned has a problem that a protrusion of the detachable knob is not inserted into the fixing groove of the top lid if the cylindrical top lid is not assembled into an exact position at the upper part of the cylindrical container.

SUMMARY OF THE INVENTION

Accordingly, the present invention is directed to a vacuum cleaner that substantially obviates one or more problems due to limitations and disadvantages of the related art.

An object of the present invention is to provide a vacuum cleaner having a dust collector that is easily attached or detached.

Another object of the present invention is to provide a vacuum cleaner enabling to fix the dust collector with ease.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a vacuum cleaner includes a head including an inlet for sucking in polluted air containing impurities from outside; a dust collector including a dust collecting container and a top lid, the dust collecting container having a handle on a side thereof, sucking in polluted air and collecting impurities, and having an opened top surface for discharging air separated from the impurities, and, the top lid including a fixing groove and a guiding member, and detachably provided at the dust collecting container for closing the opened top of the dust collecting container, wherein the guiding member is coupled to a predetermined part of the dust collecting container such that the fixing groove is positioned at a predetermined location when the top lid is assembled with the dust collecting container; a main body having a dust collector receiving recess in front part thereof wherein the dust collector is detachably provided; and a fixing device provided at an upper front portion above the dust collector receiving recess, and having a protrusion caught by the fixing groove of the top lid, the fixing device fixing the dust collector on the main body, and releasing the dust collector when the dust collector is separated from the main body.

In this case, the guiding member comprises an inserting groove provided on a side of the top lid for receiving a top end of the handle of the dust collector.

In another aspect of the present invention, a vacuum cleaner includes a head having an inlet for sucking in air containing impurities from outside by using an air suction device generating air suction force, and an agitator for separating dust from a floor; a dust collector including a dust collecting container, formed in a cylindrical form, sucking in air, collecting impurities separated from the air and discharging air separated from the impurities, wherein the dust collecting container has a handle on a side thereof and an opened top, and having an opened top surface for discharging air separated from the impurities; and a top lid detachably provided at the dust collecting container for closing the opened top of the dust collecting container, and including a fixing groove provided on a top surface thereof, and an inserting groove to which an upper end of the handle of the dust collecting container is inserted and coupled such that the fixing groove is positioned at a predetermined location when assembled with the dust collecting container; a main body having a dust collector receiving recess in front part thereof wherein the dust collector is detachably provided; a cleaner handle coupled with the main body; and a fixing device provided at an upper front portion above the dust collector receiving recess, and having a protrusion caught by the fixing groove of the top lid, the fixing device fixing the dust collector on the main body, and releasing the dust collector when the dust collector is separated from the main body.

In another aspect of the present invention, a vacuum cleaner includes a head having an inlet for sucking in air containing impurities from outside by air suction force generated by a motor, and an agitator for separating dust from a floor by an operation of the motor; a dust collector including a dust collecting container formed in a cylindrical form, having a handle on an outer wall thereof, sucking in polluted air and collecting impurities separated from the polluted air, and having an opened top surface for discharging the cleaned air separated from the impurities to a rear thereof; and a top lid detachably provided at the dust collecting container for closing the opened top of the dust collecting container, and including a fixing groove provided on a top surface thereof, an inserting groove to which an upper end of the handle of the dust collecting container is inserted and coupled such that the fixing groove is positioned at a predetermined location when assembled with the dust collecting container, and an opening handle provided at a side thereof; a main body provided at an upper part of the head, and having a dust collector receiving recess, to which the dust collector is detachably provided, in front part thereof, and having a motor therein; a cleaner handle coupled with the main body; and a fixing device provided at an upper front portion above the dust collector receiving recess, and including a first end exposed outside and a second end having a hook projected downward to be caught by the fixing groove of the top lid, the fixing device fixing the dust collector on the main body, and releasing the dust collector when the dust collector is separated from the main body.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
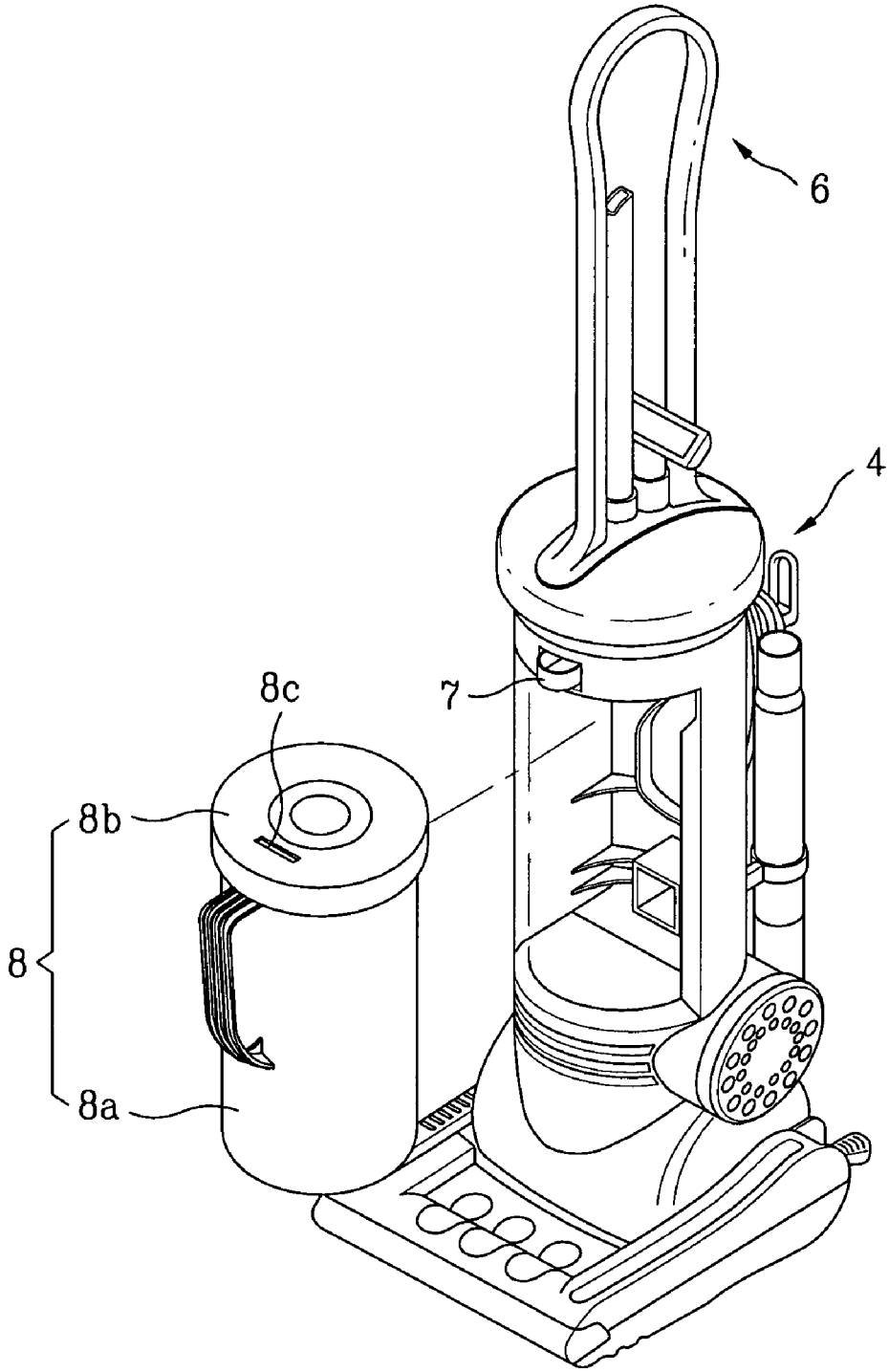
FIG. 1 Related Art
FIG. 1 illustrates an exploded perspective view of a related art upright type vacuum cleaner.
Figure 2:
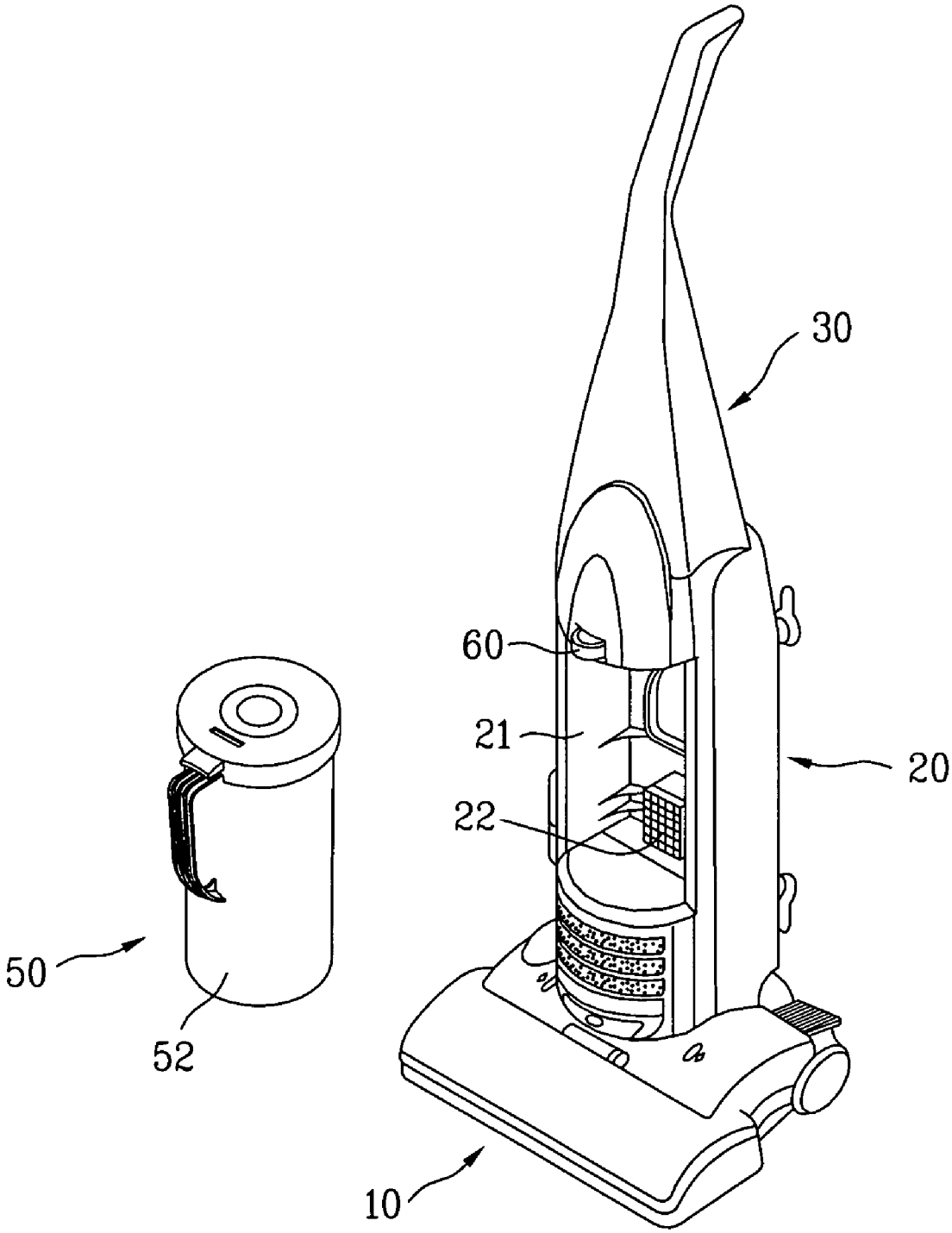
FIG. 2 illustrates an exploded perspective view showing a preferred embodiment of a vacuum cleaner in accordance with the present invention.

Referring to FIG. 2, according to a preferred embodiment of a vacuum cleaner in accordance with the present invention includes a head 10 moving along a floor and sucking in air containing impurities, a main body 20 coupled with the head, and a cleaner handle 30 coupled with the main body.

The head 10 includes wheels (not shown) at a lower part thereof, moves along the floor in a state of being close thereto and sucks in polluted air containing impurities from outside through an inlet (not shown) provided at a lower part thereof.

It is desirable that an agitator is provided in the vicinity of the head 10. The agitator is to suck in the impurities better together with outside air by separating the impurities such as dust stuck on the floor. The agitator (not shown) includes a shaft horizontally provided in the inlet, and a brush provided on an outer circumferential surface of the shaft. It is desirable that the brush is provided in a spiral direction on the outer circumferential surface of the shaft.

The main body 20 is provided at an upper part of the head 10 to be rotatable in a predetermined range. In more detail, the main body 20 is hinge coupled with a rear top portion of the head 10.

Owing to the abovementioned structure, the user can clean the floor by holding the cleaner handle 30 and adjusting the angle of the main body 20 to a desired angle according to the height of the user or location to be cleaned.

An air suction device (not shown) such as a motor generating air sucking force is provided in the main body 20, and the polluted outside air is sucked in through the inlet of the head 10 by an operation of the air suction device. It is desirable that the air suction device is coupled with the agitator of the head 10 for rotating the shaft of the agitator together with generating the sucking force for sucking the polluted air. The main body 20 desirably includes a sensor, particularly a temperature sensor (not shown) for sensing an overload of the air suction device such as the motor.

In front of the main body 20, a dust collector receiving recess 21 is provided for collecting impurities separated from the polluted air.

Figure 3:
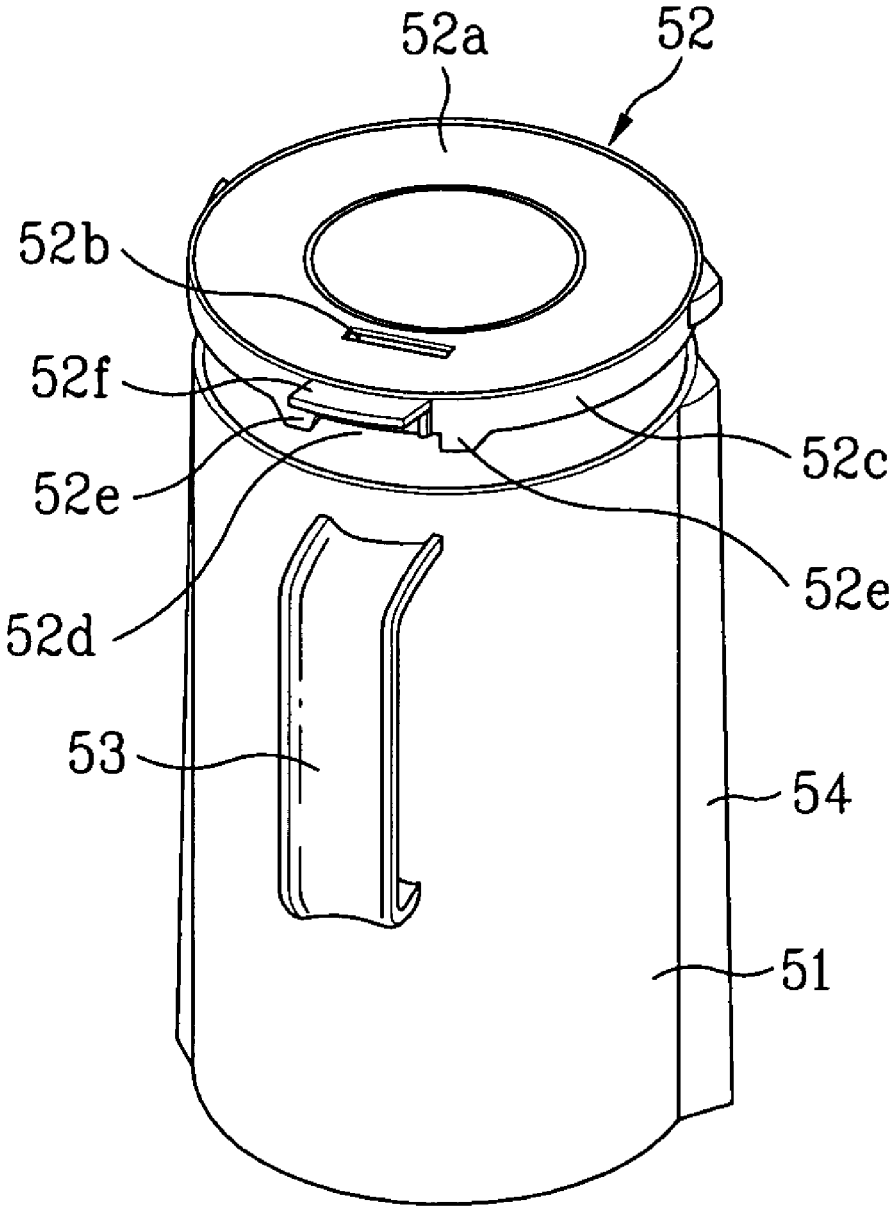
FIG. 3 illustrates an exploded perspective view of a dust collector provided in a vacuum cleaner in accordance with the present invention.
Figure 4:
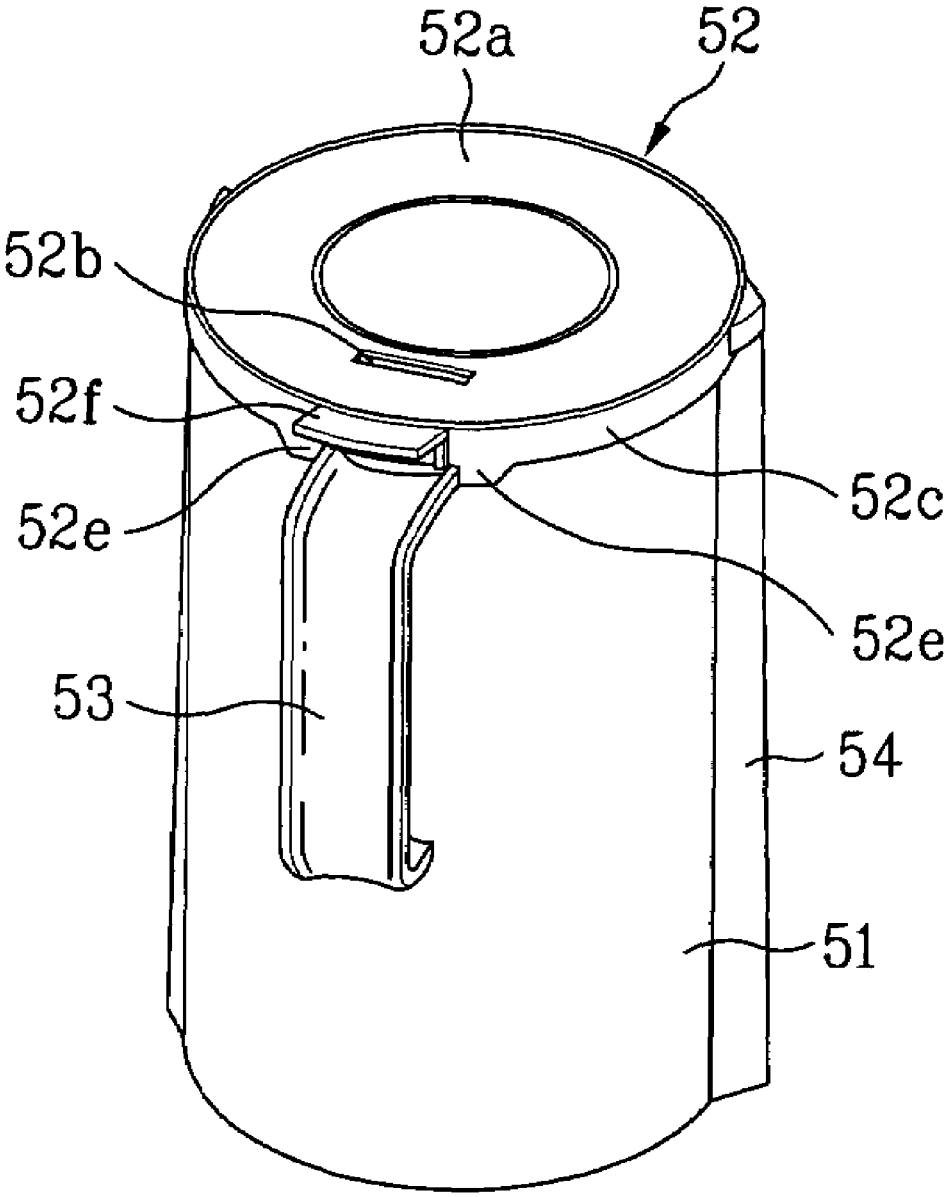
FIG. 4 illustrates a perspective view of a preferred embodiment of a dust collector provided in a vacuum cleaner in accordance with the present invention.

Referring to FIGS. 2 to 4, the dust collector receiving recess 21 is provided on a front surface of the main body 20 for receiving the dust collector 20. The dust collector receiving recess 21 is depressed corresponding to be correspondent to an exterior of the dust collector 50.

Meanwhile, the dust collector 50 sucks in the polluted air and collects impurities by separating the impurities from the polluted air and discharges cleaned air. The dust collector 50 collects the impurities by using a cyclone method or a method of filtering impurities by means of a filtering device. The cyclone method and the filtering method by means of the filtering device can of course be adopted at the same time as a method for separating impurities at the dust collector 50.

The dust collector 50 includes a dust collecting container 51 formed in a cylindrical form, having an opened top surface and discharging air from which the impurities are separated, and a top lid 52 detachably provided at the dust collecting container for opening and closing the top surface of the dust collector.

The dust collecting container 51 includes an inlet and an outlet 5 provided respectively at predetermined locations on an outer wall of the dust collecting container for collecting impurities separated from the polluted air and discharging the cleaned air, and a handle 53 provided on a front outer wall of the dust collecting container.

In this case, it is desirable that the outlet is configured to discharge the purified air to a rear side of the dust collector, and a clean air inlet 22 is provided corresponding to the outlet of the dust collector at the dust collector receiving recess 21 of the main body, so as to communicate the outlet with the clean air inlet 22.

The top lid 52 includes a lid top plate 52*a* formed in a round form and having a fixing groove 52*b* provided on the top surface thereof, and a rim 52*c* formed in a cylindrical form, coupled with an outer circumference of the lid top plate 52*a*, and closely adhered to a top end outer circumference of the dust collector 51 when assembled into the dust collecting container 51.

The dust collector 50 is detachably provided at the main body 20 so as to be separated from the main body 20 and emptied when the impurities such as dust are piled up more than a predetermined amount in the dust collector 50. For that reason, the vacuum cleaner in accordance with the present invention includes a fixing device 60 for fixing/releasing the dust collector 50 on/from the main body 20 when the dust collector 20 is separated.

The fixing device 60 includes a protrusion caught in the fixing groove 52*a* of the top lid when the dust collector 50 is provided at the main body 20.

In more detail, the fixing device 60 is configured to have a first end exposed outside to form a pushing member and a second end having a protrusion such as a hook projected downward to be caught by the fixing groove 52*b*, and is provided at a top front of the dust collector receiving recess of the main body to be manipulated by a user.

However, when the dust collector 50 is provided at the main body 20, the fixing groove needs to be provided exactly under the hook of the fixing device 60 for being coupled with the fixing device 60. For that reason, the top lid 52 of the dust collector further includes a guiding member so as to locate the fixing groove 52*a* at a predetermined position all the time when the top lid 52 is assembled into the dust collecting container 51.

As an example of the guiding member, an inserting groove 52*d* is provided at the rim 52*c* on the side of the top lid such that a top end of the handle 53 of the dust collector is inserted and coupled thereto.

When the top lid 52 is coupled with the top of the dust collector 51, the fixing groove 52*b* provided on a top surface of the top lid 52 is positioned at a predetermined location all the time, thereby removing a problem that the dust collector 50 is not coupled with the hook of the fixing device 60 during assembly of the dust collector 50.

In addition to the abovementioned, it is desirable that the top lid 52 further includes a lid opening handle 52*f* for opening the top lid 52 when the impurities such as dust collected in the dust collector is removed.

The lid opening handle 52*f* in accordance with the present invention, although can be formed at various places and in various forms, is horizontally projected frontward from a predetermined location, particularly from the top of the inserting groove 52*d*.

The dust collector 51 further includes a couple of projected ribs 54 provided on the outer surface of the dust collecting container, formed in a long form in up and down direction on a side thereof, and being in contact with both front ends of the dust collector receiving recess 21 so as to install the dust collector 50 at the main body exactly and maintain airtightness between the dust collector 50 and the main body 20.

Next, a process of detaching the dust collector 50 from the main body 20 will be described, the dust collector 50 structured as above-mentioned.

First, for providing the dust collector 50 at the main body 20, when the top lid is coupled with the top part of the dust collecting container 51 such that the handle 53 of the dust collecting container is inserted into the inserting groove of the top lid, the dust collector is assembled in a state that the fixing groove 52*b* of the top lid is positioned at a predetermined location.

When a rear outer wall of the dust collector 50 is closely adhered to a rear inner wall of the dust collector receiving recess 21 by pushing the dust collector 50 into the dust collector receiving recess 21 of the main body in a direction of front to rear, the hook 64 of the fixing device 60 is caught by the fixing groove 52*b*, thereby fitting the dust collector 50 on the main body.

When the vacuum cleaner with the dust collector 50 is operated, cleaning is performed by sucking in polluted outside air through the inlet of the head 10 via an operation of the air suction device, and discharging the cleaned air to the outside through the main body 20, the cleaned air separated from the impurities such as dust at the dust collector 50.

Next, if the impurities such as dust are piled up more than a predetermined amount in the dust collector 50 after operating the vacuum cleaner for a predetermined time, the dust collector 50 needs to be separated from the main body 20 so as to be emptied.

For that reason, the user releases the fixed dust collector 50 by manipulating the pushing member of the fixing device 60, the pushing member projected frontward of the main body, and releasing the hook from the fixing groove 52*b*. In this instance, the user can hold the handle 53 of the dust collector provided in front of the dust collector 50, and separate the dust collector from the main body 20.

Although the fixing groove is configured to be at a predetermined location all the time in the present invention and thus the guiding member is introduced, the guiding member including the inserting groove 52*d* coupled with the handle 53 of the dust collector, there are various methods for positioning the fixing groove at the predetermined location all the time.

For example, the method for positioning the fixing groove at the predetermined location includes using the protrusion provided at either of the dust collecting container or the top lid, and a receiving groove provided at the other for receiving the protrusion, or using the top lid coupled with the dust collecting container formed in a symmetrical form.

Although the upright type vacuum cleaner having a main body coupled with the top of the head is mainly discussed in accordance with the preferred embodiment of the present invention, the structure is not limited to the present invention, but can be applied to a canister type vacuum cleaner having a separate head and main body.

The effect of the vacuum cleaner is summarized as follows. First, according to the vacuum cleaner in accordance with the present invention, the dust collector separately collecting impurities such as dust is fixed on the main body, or the fixing device for releasing the fixed state of the dust collector is provided. Therefore, it is easy to detach the dust collector, and the dust collector is not separated from the dust collector during cleaning.

Second, according to the vacuum cleaner of the present invention, the fixing groove is located at the hook of the fixing device exactly. Therefore, it is easy to fix the dust collector.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A vacuum cleaner comprising:

a head including an inlet for sucking in air containing impurities from outside;

a dust collector comprising:

a dust collecting container sucking in air, collecting impurities and discharging air separated from the impurities, wherein the dust collecting container has a handle on a side thereof and an opened top; and a top lid including a fixing groove and a guiding member, and detachably provided at the dust collecting container for closing the opened top of the dust collecting container, wherein the guiding member is coupled to a predetermined part of the dust collecting container such that the fixing groove is positioned at a predetermined location when the top lid is assembled with the dust collecting container, and wherein the guiding member comprises an inserting groove provided on a side of the top lid for receiving a top end of the handle of the dust collector;

a main body having a dust collector receiving recess in front part thereof, wherein the dust collector is detachably provided in the dust collector receiving recess; and a fixing device provided at an upper front portion above the dust collector receiving recess, and having a protrusion caught by the fixing groove of the top lid, the fixing device fixing the dust collector on the main body, and releasing the dust collector when the dust collector is separated from the main body, wherein a width of the inserting groove at least substantially corresponds to a width of the handle to prevent the top lid from moving on the dust collector.

2. The vacuum cleaner as claimed in claim 1, wherein the inserting groove is formed by a couple of protrusions projected downward from a lower end on the side of top lid.

3. The vacuum cleaner as claimed in claim 1, wherein the top lid further comprises a lid-opening handle.

4. The vacuum cleaner as claimed in claim 3, wherein the lid-opening handle is horizontally projected from one side of the top lid.

5. The vacuum cleaner as claimed in claim 1, wherein the dust collector discharges clean air to a rear side thereof.

6. A vacuum cleaner comprising:

a head having an inlet for sucking in air containing impurities from outside by an air suction device generating air suction force, and an agitator separating dust from a floor;

a dust collector comprising:

a dust collecting container, formed in a cylindrical form, sucking in air, collecting impurities separated from the air and discharging air separated from the impurities, wherein the dust collecting container has a handle on a side thereof and an opened top; and a top lid detachably provided at the dust collecting container for closing the opened top of the dust collecting container, and including a fixing groove provided on a top surface thereof, and an inserting groove to which an upper end of the handle of the dust collecting container is inserted and coupled such that the fixing groove is positioned at a predetermined location when assembled with the dust collecting container;

a main body having a dust collector receiving recess in front part thereof, wherein the dust collector is detachably provided in the dust collector receiving recess;

a cleaner handle coupled with the main body; and a fixing device provided at an upper front portion above the dust collector receiving recess, and including a first end exposed outside and a second end having a protrusion caught by the fixing groove of the top lid, the fixing device fixing the dust collector on the main body, and releasing the dust collector when the dust collector is separated from the main body, wherein a width of the inserting groove corresponds to a width of the handle to prevent the top lid from moving on the dust collecting container.

7. The vacuum cleaner as claimed in claim 6, wherein the inserting groove is formed by a couple of protrusions projected downward from a lower end on the side of top lid.

8. The vacuum cleaner as claimed in claim 6, wherein the top lid further comprises a lid-opening handle.

9. The vacuum cleaner as claimed in claim 8, wherein the lid-opening handle is projected frontward form the top lid.

10. The vacuum cleaner as claimed in claim 6, wherein the agitator is operated by the air suction device.

11. The vacuum cleaner as claimed in claim 10, wherein the agitator comprises:

a shaft rotated by the operation of the air suction device; and a brush provided on an outer circumference of the shaft.

12. The vacuum cleaner as claimed in claim 11, wherein the brush is formed in a spiral form.

13. The vacuum cleaner as claimed in claim 6, wherein the main body further comprises a sensor for sensing an overload of the air suction device.

14. The vacuum cleaner as claimed in claim 6, wherein the dust collector further comprises at least one projected rib provided on the outer surface of the dust collecting container, wherein the at least one rib extends in a longitudinal direction of the dust, and wherein the rib contacts the dust collector receiving recess so as to install the dust collector at the main body exactly and maintain airtightness between the dust collector and the main body.

15. A vacuum cleaner, comprising:

a head having an inlet for sucking in air containing impurities from outside by air suction force generated by a motor, and an agitator for separating dust from a floor by an operation of the motor;

a dust collector comprising:

a dust collecting container formed in a cylindrical form, sucking in air, collecting impurities separated from the air and discharging clean air to a rear thereof, wherein the dust collecting container comprises a handle on an outer wall thereof and an opened top; and a top lid detachably coupled to the dust collecting container for closing the opened top of the dust collecting container, wherein a fixing groove is provided on a top surface thereof, wherein the top lid also includes an inserting groove to which an upper end of the handle of the dust collecting container is inserted, and wherein insertion of the handle into the inserting groove causes the fixing groove to be positioned at a predetermined location when the top lid is assembled with the dust collecting container;

a main body provided at an upper part of the head, and having a dust collector receiving recess, to which the dust collector is detachably provided, in front part thereof, and having a motor therein;

a cleaner handle coupled with the main body; and a fixing device provided at an upper front portion above the dust collector receiving recess, and including a first end exposed outside and a second end having a hook projected downward to be caught by the fixing groove of the top lid, the fixing device fixing the dust collector on the main body, and releasing the dust collector when the dust collector is separated from the main body, wherein a width of the inserting groove corresponds to a width of the handle to prevent the top lid from moving on the dust collector.

16. The vacuum cleaner as claimed in claim 15, wherein the inserting groove is formed by a couple of protrusions projected downward from a lower end on the side of top lid.

17. The vacuum cleaner as claimed in claim 16, wherein the top lid includes a lid-opening handle that projects from the side of the top lid.

18. The vacuum cleaner as claimed in claim 15, wherein the agitator comprises:

a shaft provided to be horizontal to an axis of the motor; and a brush provided on an outer circumference of the shaft.

19. The vacuum cleaner as claimed in claim 18, wherein the brush is formed in a spiral form on an outer circumference of the shaft of the agitator.

* * * * *